US010544611B2

(12) United States Patent
Nicholas, III et al.

(10) Patent No.: US 10,544,611 B2
(45) Date of Patent: Jan. 28, 2020

(54) REMOVABLE HINGE ASSEMBLIES

(71) Applicant: Hubbell Incorporated, Shelton, CT (US)

(72) Inventors: Donald Wayne Nicholas, III, Staunton, IL (US); Matthew David Raetz, Belleville, IL (US)

(73) Assignee: HUBBELL INCORPORATED, Shelton, CT (US)

( * ) Notice: Subject to any disclaimer, the term of this patent is extended or adjusted under 35 U.S.C. 154(b) by 66 days.

(21) Appl. No.: 15/461,145

(22) Filed: Mar. 16, 2017

(65) Prior Publication Data

US 2017/0268269 A1 Sep. 21, 2017

Related U.S. Application Data

(60) Provisional application No. 62/309,604, filed on Mar. 17, 2016.

(51) Int. Cl.

| | |
|---|---|
| ***E05D 7/10*** | (2006.01) |
| ***E05D 3/02*** | (2006.01) |
| ***E05D 5/12*** | (2006.01) |

(52) U.S. Cl.

CPC ..... *E05D 7/1005* (2013.01); *E05D 3/02* (2013.01); *E05D 5/12* (2013.01); *E05D 2003/027* (2013.01); *E05D 2007/1027* (2013.01); *E05Y 2900/20* (2013.01); *Y10T 16/53607* (2015.01)

(58) Field of Classification Search

CPC ... E05D 7/1005; E05D 7/1055; E05D 7/1016; E05D 3/02; E05D 5/06; E05D 5/12; E05D 5/128; E05D 2003/027; E05D 2007/1027; E05Y 2600/626; E05Y 2600/634; E05Y 2800/174; E05Y 2900/20; E05Y 2900/208; E05Y 2900/21; Y10T 16/53607; Y10T 16/5357; Y10T 16/535; Y10T 16/558; Y10T 16/553; Y10T 16/5535

USPC ..... 16/254, 257, 262, 387, 380, 381

See application file for complete search history.

(56) References Cited

U.S. PATENT DOCUMENTS

| | | | |
|---|---|---|---|
| 3,188,686 | A | 6/1965 | Orcutt |
| 4,997,218 | A | 3/1991 | Culling |
| 5,259,091 | A | 11/1993 | Mordick |
| 5,282,293 | A | 2/1994 | Pedoeem |
| 5,665,695 | A | 9/1997 | Jegers et al. |

(Continued)

FOREIGN PATENT DOCUMENTS

| | | |
|---|---|---|
| CN | 204060271 | 12/2014 |

OTHER PUBLICATIONS

International Search Report and Written Opinion mailed in corresponding International Application PCT/US17/22777 dated Jun. 9, 2017, 10 pages.

(Continued)

*Primary Examiner* — William L Miller
(74) *Attorney, Agent, or Firm* — Wissing Miller LLP

(57) ABSTRACT

Hinge assemblies having a tub knuckle, a lid leaf and a hinge pin assembly are provided. The tub knuckle has a base, a first pin holder extending from the base and a second pin holder extending from the base and spaced from the first pin holder. The lid leaf has a mounting plate and a pin holder. The hinge pin assembly is movable between a closed position and an open position, and includes a hinge pin and a retainer assembly that can be used to lock the hinge pin assembly in the closed and open positions.

22 Claims, 9 Drawing Sheets

(56) References Cited

U.S. PATENT DOCUMENTS

| | | | | |
|---|---|---|---|---|
| 5,722,121 | A | 3/1998 | Lau et al. | |
| 5,867,870 | A | 2/1999 | Kluting | |
| 5,884,365 | A | 3/1999 | Kluting | |
| 6,070,297 | A | 6/2000 | Borer | |
| 6,348,800 | B1 | 2/2002 | Haensgen et al. | |
| 6,438,800 | B1 * | 8/2002 | Narang | E05D 7/1005 16/229 |
| 6,721,994 | B2 | 4/2004 | Bowman et al. | |
| 7,934,782 | B2 | 5/2011 | Christie | |
| 8,464,396 | B2 | 6/2013 | Westby et al. | |
| 9,464,469 | B2 * | 10/2016 | Fraser | E05D 11/06 |
| 2010/0218344 | A1 | 9/2010 | Van Gennep | |
| 2013/0069511 | A1 | 3/2013 | Westby | |

OTHER PUBLICATIONS

EMKA 125 Degree Hinge Advertisement, Feb. 3, 2016.
Hoffman, C-SD Concept Series Catalog page, Mar. 2014.

* cited by examiner

REMOVABLE HINGE ASSEMBLIES

CROSS REFERENCE TO RELATED APPLICATIONS

The present application is based on and claims benefit from U.S. Provisional Application Ser. No. 62/309,604 filed Mar. 17, 2016 entitled "Removable Hinge Assemblies" the entire contents of which are herein incorporated by reference.

BACKGROUND

Field

The present disclosure relates generally to hinge assemblies, and more particularly to concealable hinge assemblies having a hinge lid leaf that can be removed from a hinge tub knuckle using a lockable pin retainer assembly.

Description of the Related Art

Hinges with a pin inserted through a hinge body and hinge leaf for various types of enclosures are known. For large enclosures, the doors of such enclosures are often removed when maintenance or other activities are performed within the enclosure. To remove the enclosure door of such large enclosures, the hinges are often disassembled, which can be time consuming, and risks losing parts of the hinge.

SUMMARY

The present disclosure provides hinge assemblies that are concealable and have a hinge lid leaf that can be removed from a hinge tub knuckle using a lockable pin retainer assembly. The hinge assemblies according to the present disclosure allow an enclosure door to be removed from the enclosure tub using a removable locking hinge pin assembly, removing the need to disassemble the entire hinge assembly. The hinge pin assembly can be locked in a closed position and can be partially pulled out so that the enclosure door can be removed without completely removing the hinge pin assembly, thus minimizing the risk of losing the hinge pin assembly. The hinge assembly according to the present disclosure also allows users to completely remove the hinge pin assembly, if desired.

In one exemplary embodiment, the hinge assembly includes a tub knuckle, a lid leaf, and a hinge pin assembly. The tub knuckle has a base, a first pin holder extending from the base and a second pin holder extending from the base and spaced from the first pin holder. The lid leaf has a mounting plate and a pin holder. The hinge pin assembly is movable between a closed position and an open position, and includes a hinge pin and a retainer assembly. The hinge pin can engage the first and second pin holders, and the lid leaf pin holder to couple the tub knuckle to the lid leaf. The hinge pin can also disengage from the first pin holder and the lid leaf pin holder to decouple the tub knuckle to the lid leaf. The retainer assembly is provided to automatically lock the hinge pin assembly in the closed position and in the open position.

The present disclosure also provides enclosures that utilize the hinge assemblies that are concealable and have a hinge lid leaf that can be removed from a hinge tub knuckle using a lockable pin retainer assembly. An exemplary embodiment of an enclosure according to the present disclosure includes an enclosure tub, a removable enclosure door mounted to the enclosure tub, and a hinge assembly. The hinge assembly is similar to the hinge assembly described above.

BRIEF DESCRIPTION OF THE DRAWINGS

The figures depict configurations for purposes of illustration only. One skilled in the art will readily recognize from the following description that alternative configurations of the structures illustrated herein may be employed without departing from the principles described herein, wherein.

DETAILED DESCRIPTION

Figure 1:
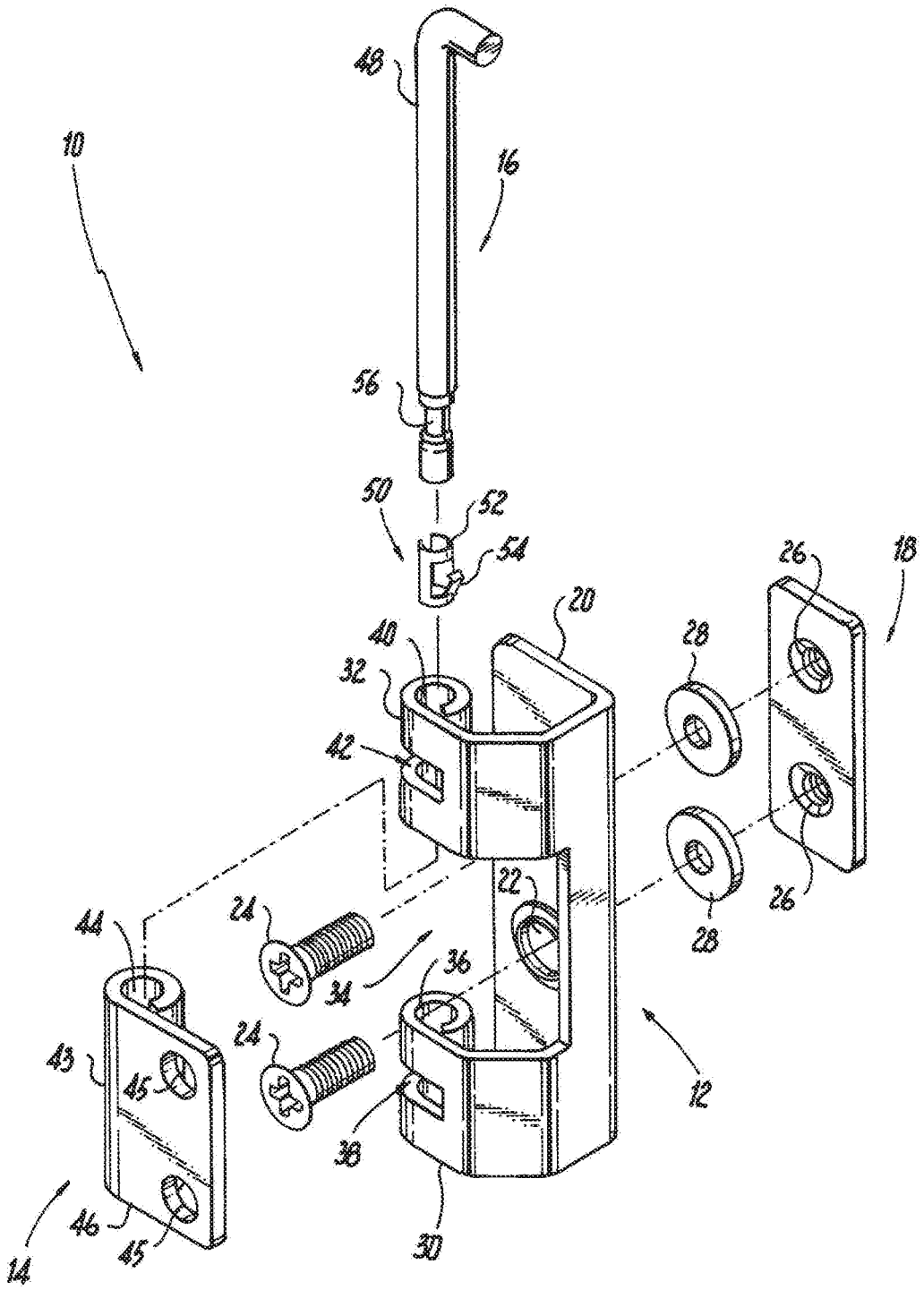
FIG. 1 is an exploded view of an exemplary embodiment of a hinge assembly according to the present disclosure.

The present disclosure provides descriptions of embodiments for hinge assemblies that are concealed by an enclosure door when the door is in a closed position, and that have a lid leaf that can be easily decoupled from a hinge tub knuckle to permit removal of the enclosure door from the enclosure tub. Referring to FIG. 1, an exemplary embodiment of a hinge assembly according to the present disclosure is shown. The hinge assembly 10 includes a tub knuckle 12 that can be mounted to an enclosure tub, and a lid leaf 14 that can be mounted to an enclosure door. A hinge pin assembly 16 is used to releasably couple the tub knuckle 12 to the lid leaf 14. In some embodiments, a retainer bracket 18 is used to secure the tub knuckle 12 to a front wall of an enclosure tub, as will be described in more detail below.

In the exemplary embodiment shown in FIG. 1, the tub knuckle 12 includes a base 20 having one or more mounting apertures 22 used to secure the base 20 to, for example, a front wall of an enclosure tub using fasteners 24. When securing the base 20 of the tub knuckle 12 to an enclosure tub using fasteners 24, the retainer bracket 18 may be used. The retainer bracket 18 includes one or more tapped mounting holes 26, such that when the tub knuckle 12 is placed against an outer surface of the front wall of the enclosure tub, the retainer bracket 18 can be placed against an inner surface of the front wall of the enclosure tub opposite the tub knuckle 12. The fasteners 24 can then be inserted through the one or more mounting apertures 22, through corresponding apertures in the front wall of the enclosure tub, and into the tapped mounting apertures 26 of the retainer bracket 18. The fasteners 24 can then be tightened to secure the tub knuckle 12 to the enclosure. To provide a watertight seal between the tub knuckle 12 and the enclosure tub, the tub knuckle 12 may include embosses 27, shown in FIG. 9, to receive sealing washers 28, such that when the fasteners 24 are tightened the washers 28 seal the apertures in the front wall of the enclosure tub. In another embodiment, the front wall of an enclosure tub may include tapped mounting holes, so that the fasteners 24 can be inserted through the one or more apertures in the base 20 and secured to the tapped mounting holes in the front wall of the enclosure tub. In another embodiment, the base 20 can be secured to an enclosure tub by welding the base to the front wall of the enclosure tub.

Continuing to refer to FIG. 1, the tub knuckle 12 also includes a first pin holder 30 formed into or connected to the base 20, and a second pin holder 32 formed into or connected to the base 20. The first pin holder 30 and the second pin holder 32 are formed into or connected to the base 20 so that there is a gap 34 between the pin holders 30 and 32 that is capable of receiving the lid leaf 14. The first pin holder 30 includes a pin receiving hole 36 and a slot 38 that at least partially extends into the pin receiving hole 36. The second pin holder 32 includes a pin receiving hole 40 and a slot 42 that at least partially extends into the pin receiving hole 40.

The lid leaf 14 includes a pin holder 43 having a pin receiving hole 44 formed into or connected to a mounting plate 46. The mounting plate 46 is configured to fit within the gap 34 in the tub knuckle 12. The mounting plate 46 can be secured to an enclosure door by, for example, welding the mounting plate to the enclosure door, or using fasteners, e.g., bolts, passed through mounting apertures 45 in the mounting plate 46 and through corresponding apertures in the enclosure door, and secured with nuts. In another embodiment, the mounting plate can be secured to the enclosure door using threaded fasteners secured to tapped mounting holes in the enclosure door. In another embodiment, the mounting plate 46 can be secured to the enclosure door by welding the mounting plate to the enclosure door.

The hinge pin assembly 16 includes a hinge pin 48 and a pin retainer assembly 50. The hinge pin 48 is configured to slide within the pin receiving hole 40 in second pin holder 32, the pin receiving hole 44 in the lid leaf 14, and the pin receiving hole 36 in first pin holder 30 to releasably couple the tub knuckle 12 to the lid leaf 14. In addition, the hinge pin 48 renders the lid leaf 14 movable relative to the tub knuckle 12 so that when the hinge assembly 10 is installed in an enclosure, the enclosure door can swing between open and closed positions. The pin retainer assembly 50 includes a body 52 configured to fit within a retainer holding portion 56 of the hinge pin 48. Preferably, when the body 52 is positioned within the retainer holding portion 56 of hinge pin 48, the outer diameter of the hinge pin is not substantially increased so that the hinge pin 48 can slide within the pin receiving holes as described above. The pin retainer assembly 50 also includes a retaining spring 54 that is used to releasably lock the hinge pin assembly 16 in open and closed positions. The retaining spring 54 is normally biased at an angle relative to a longitudinal axis of the body 52, which in this exemplary embodiment is parallel to the long axis of the hinge pin 48. The retaining spring 54 can be compressed or depressed towards the body 52 to release the retaining spring when the hinge pin assembly 16 is locked in the open and closed positions.

Preferably, the tub knuckle 12, lid leaf 14, hinge pin assembly 16, and retainer bracket 18 are made of a rigid material capable of supporting the weight of an enclosure door. Non-limiting examples of such rigid materials include metals, such as stainless steel, metal alloys, rigid plastic materials and composite materials.

Figure 2:
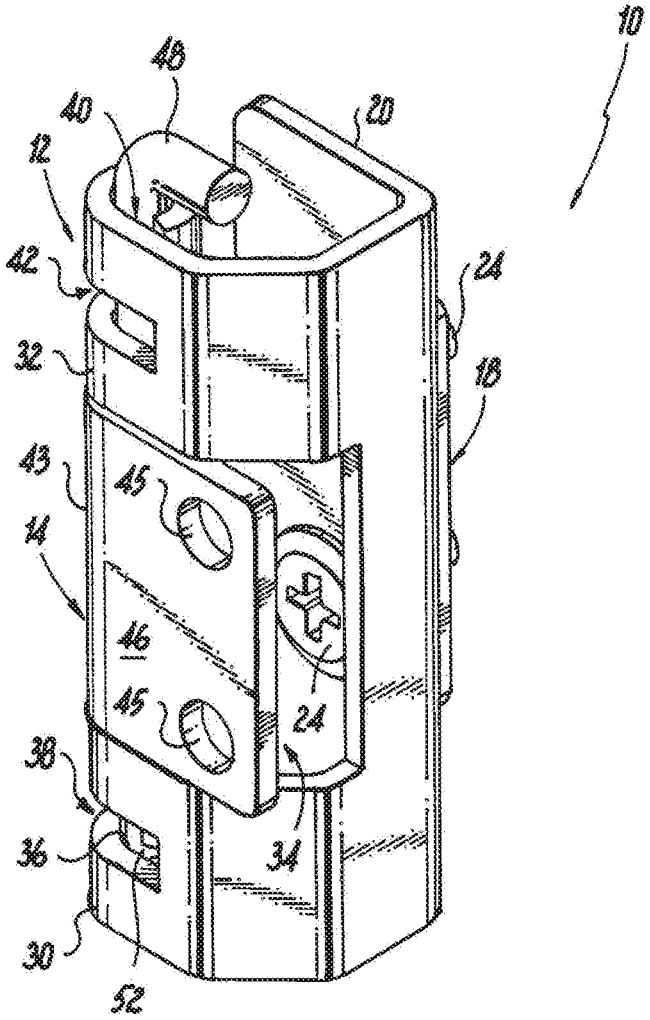
FIG. 2 is a perspective view of the hinge assembly of FIG. 1, illustrating a hinge pin assembly locked in a closed position.
Figure 3:
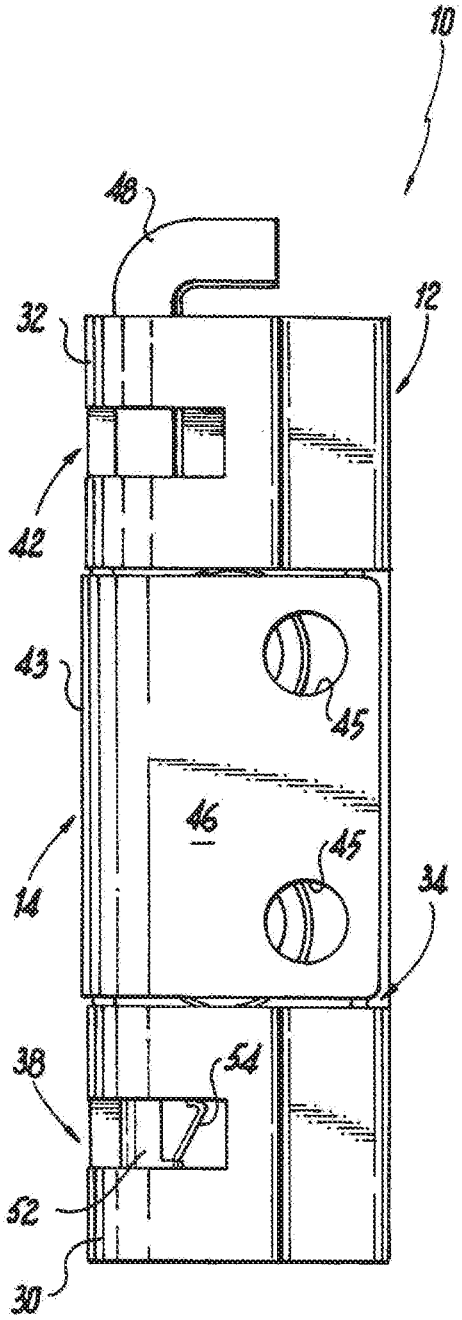
FIG. 3 is a top plan view of the hinge assembly of FIG. 2.

Referring to FIGS. 2 and 3, the components of the hinge assembly 10 are assembled, and the hinge pin assembly 16 is in a closed position. When in the closed position, the hinge pin 48 is positioned within the pin receiving hole 40 in second pin holder 32, the pin receiving hole 44 in the lid leaf 14, and the pin receiving hole 36 in first pin holder 30. In the closed position, the pin retainer assembly 50 is within the pin retaining hole 36 of the first pin holder 30, and the retaining spring 54 is in the slot 38 in the first pin holder 30 so that the retaining spring 54 is in its normal bias position at an angle relative to the body 52 of the pin retainer assembly 50, thus locking the hinge pin assembly 16 in the closed position.

Figure 4:
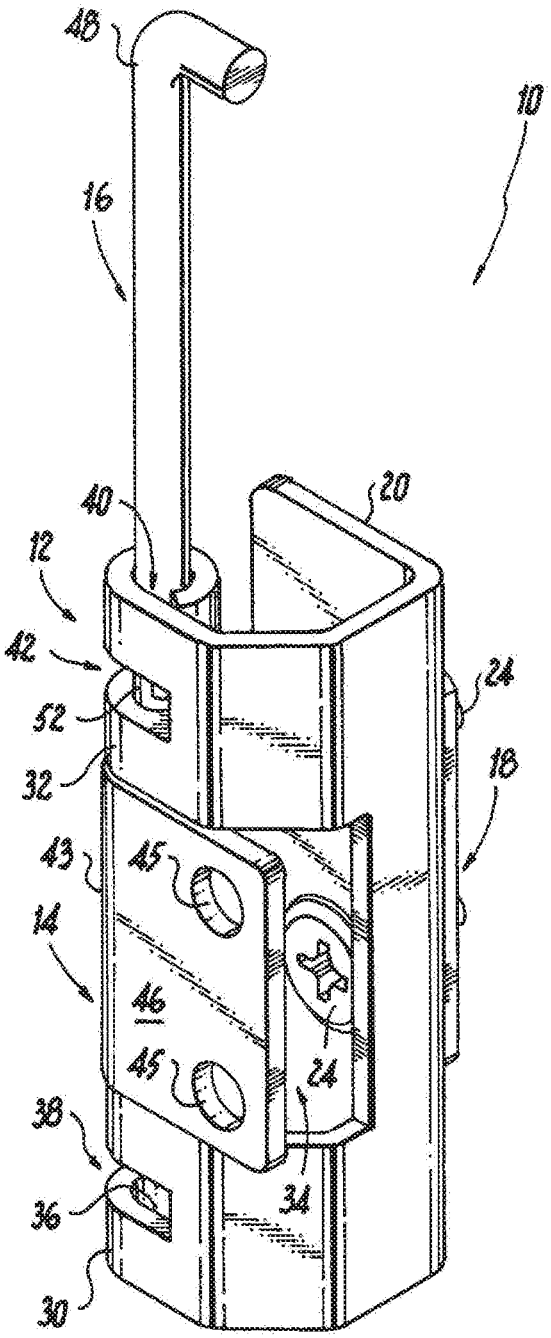
FIG. 4 is a perspective view of the hinge assembly of FIG. 1, illustrating the hinge pin assembly locked in an open position.
Figure 5:
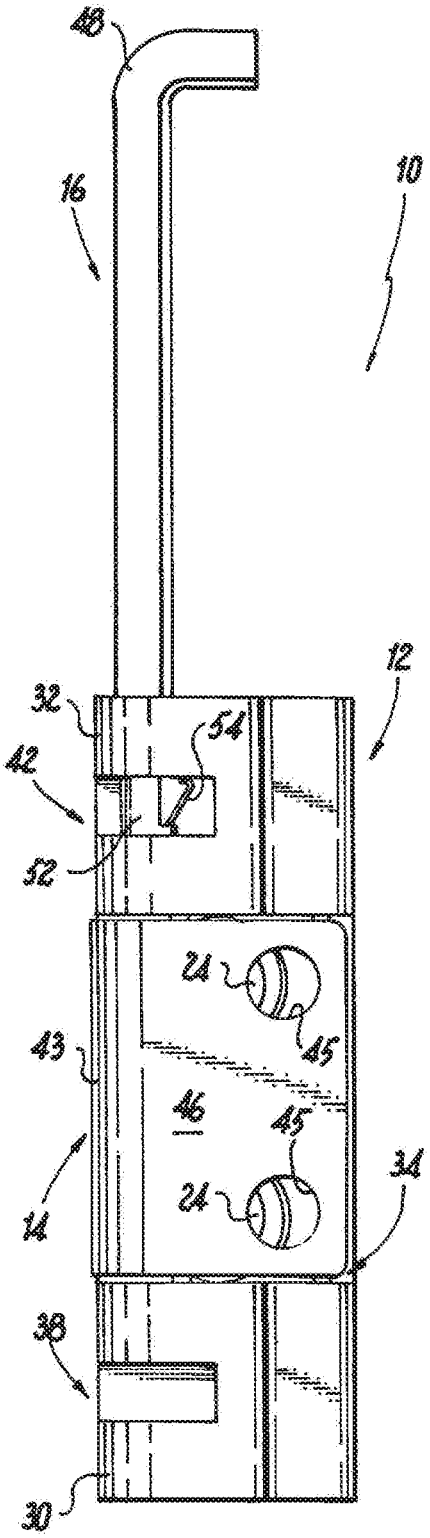
FIG. 5 is a top plan view of the hinge assembly of FIG. 4.

Referring to FIGS. 4 and 5, the components of the hinge assembly 10 are assembled, and the hinge pin assembly 16 is in an open position. When in the open position, the hinge pin 48 is positioned within the pin receiving hole 40 in second pin holder 32, and the retaining spring 54 is in the slot 42 in the second pin holder 32 so that the retaining spring 54 is in its normal bias position at an angle relative to the body 52 of the pin retainer assembly 50, thus locking the hinge pin assembly 16 in the open position. When the hinge pin assembly 16 is in the open position, the lid leaf 14 is decoupled from the tub knuckle 12 so that the lid leaf can be removed from the tub knuckle. The present disclosure also contemplates that the hinge pin assembly 16 can be completely removed from the tub knuckle 12, if desired, as described below.

In the exemplary embodiment of FIGS. 1-3, to couple the tub knuckle 12 to the lid leaf 14, the hinge pin 48 is inserted into pin receiving hole 40 in the right side pin holder 32, and passed through the pin receiving hole 44 in the lid leaf 14, and then through the pin receiving hole 36 in the first pin holder 30. While the above described coupling of the tub knuckle 12 to the lid leaf 14 is for a left side door swing, the hinge assembly 10 described herein can be used for a left side or a right side door swing. For a right side door swing, the hinge assembly 10 would be inverted so that to couple the tub knuckle 12 to the lid leaf 14, the hinge pin 48 would be inserted into pin receiving hole 36 in the left side pin holder 30, and passed through the pin receiving hole 44 in the lid leaf 14, and then through the pin receiving hole 40 in the second pin holder 32. As the hinge pin 48 is passed through the pin receiving holes as described above, the retaining spring 54 of the pin retainer assembly 50 is compressed towards the body 52 of the pin retainer assembly 50, such that the hinge pin 48 is not obstructed by the retaining spring from sliding within the pin receiving holes.

In the exemplary embodiment of FIGS. 1, 4 and 5, to decouple the tub knuckle 12 from the lid leaf 14, the retaining spring 54 is first released so that the hinge pin 48 can be removed from the pin receiving hole 36 in the left side pin holder 30, and from the pin receiving hole 44 in the lid leaf 14, and locked in the pin receiving hole 40 in the second pin holder 32. To release to the retaining spring 54, the hinge pin 48 is pushed so that the hinge pin is moved further into the pin receiving hole 36 in the first pin holder 30. By pushing the hinge pin 48 in this way, the retaining spring 54 engages the wall of the pin receiving hole 36 and is compressed towards the body 52 of the pin retainer assembly 50. Compressing the retaining spring 54 releases the retaining spring 54 from the slot 38. Once the retaining spring 54 is released, the hinge pin assembly 16 can be moved to the open position. When moving the hinge pin assembly 16 to the open position, as the pin retainer assembly 50 passes the slot 38 a tool, instrument or other mechanism is placed within the slot 38 so that the retaining spring 54 remains compressed and can pass through the slot 38 without locking the hinge pin assembly 16 in the closed position. When the hinge pin assembly 16 enters the second pin holder 32, the retaining spring 54 will snap back to its normal position in slot 42 locking the hinge pin assembly 16 in the open position. To remove the hinge pin assembly 16 from the hinge assembly 10, the hinge pin 48 is pushed so that the hinge pin is moved further into the pin receiving hole 40 in the second pin holder 32. By pushing the hinge pin 48 in this way, the retaining spring 54 engages the wall of the pin receiving hole 40 and is compressed towards the body 52 of the pin retainer assembly 50. Compressing the retaining spring 54 releases the retaining spring 54 from the slot 40. Once the retaining spring 54 is released, the hinge pin assembly 16 can be removed from the hinge assembly 16. When removing the hinge pin assembly 16 from the hinge assembly 10, as the pin retainer assembly 50 passes the slot 42 a tool, instrument or other mechanism is placed within the slot 42 so that the retaining spring 54 remains compressed and can pass through the slot 42 without locking the hinge pin assembly 16 in the open position.

While the above described decoupling of the tub knuckle 12 from the lid leaf 14 is for a left side door swing, as previously noted, the hinge assembly 10 described herein can be used for a left side or a right side door swing. Based upon the disclosure for decoupling the tub knuckle 12 from the lid leaf 14 for a left side door swing, one skilled in the art would readily appreciate how to decouple the tub knuckle 12 from the lid leaf 14 for a right side door swing.

Figure 6:
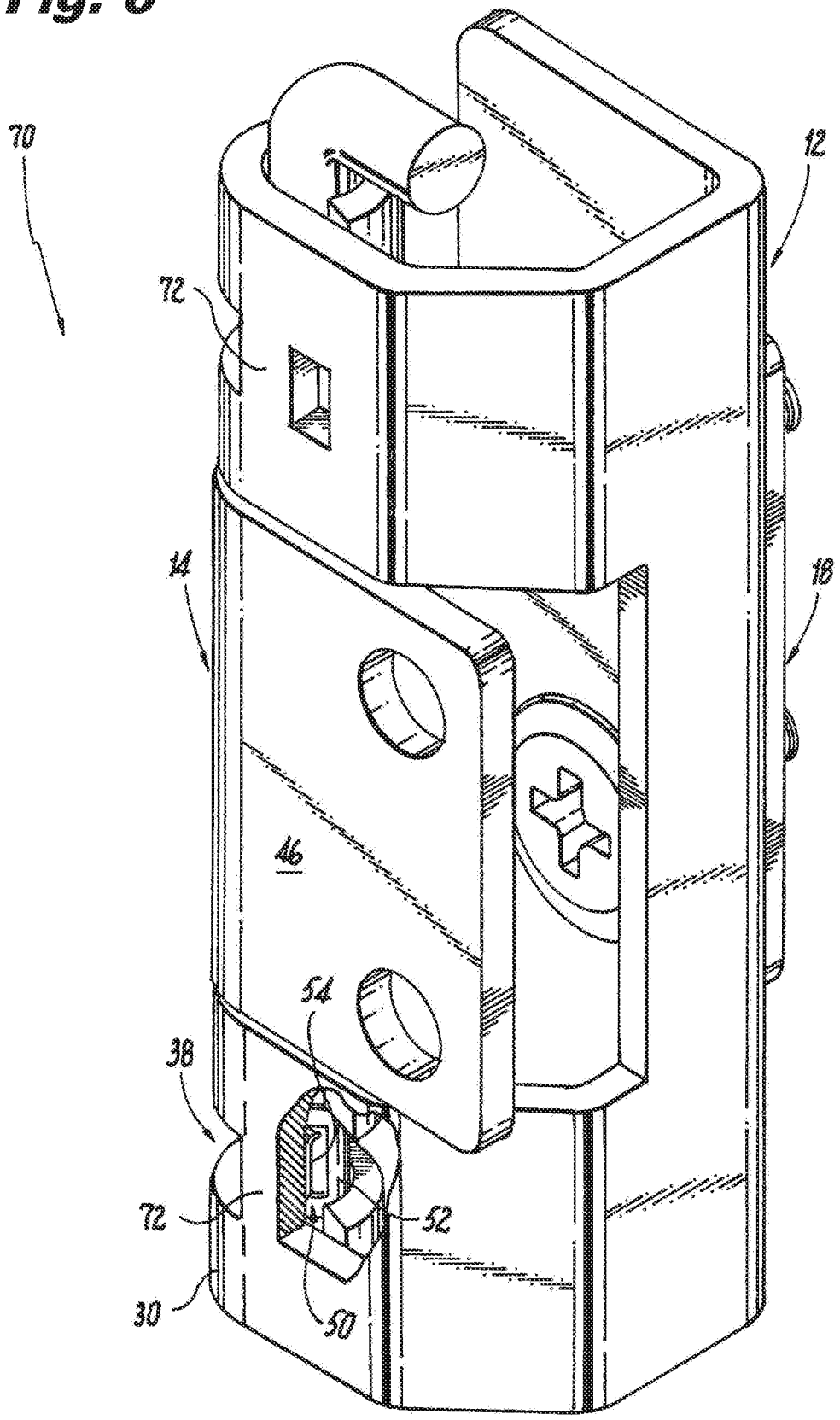
FIG. 6 is a perspective view of another exemplary embodiment of a hinge assembly according to the present disclosure, illustrating a bridge that facilitates moving the hinge pin to the open position.

Referring to FIG. 6, another exemplary embodiment of a hinge assembly 70 according to the present disclosure is shown. In this exemplary embodiment, the hinge assembly 70 is substantially the same as the hinge assembly 10 described above, such that like components will have the same reference numeral as provided above, and for the sake of clarity will not be described again. In this embodiment, the slot 38 in the first pin holder 30 and the slot 42 in the second pin holder 32 have a bridge 72 spanning the respective slot that is configured to maintain the retaining spring 54 in compression when decoupling the tub knuckle 12 from the lid leaf 14 as described above. More specifically, when moving the pin retainer assembly 50 through the slot 38 or 42, the retaining spring 54 is aligned with the bridge 72 by, for example, rotating the hinge pin assembly 16 so that the bridge 72 engages the retaining spring 54 so that the retaining spring remains compressed preventing the retainer spring 54 from snapping back to its normal position. This embodiment, removes the need to insert a tool, or other instrument or mechanism into the slot 38 to prevent the retaining spring 54 from locking the hinge pin assembly 16 in the closed position as the pin retaining assembly 50 passes through the respective slot.

Figure 7:
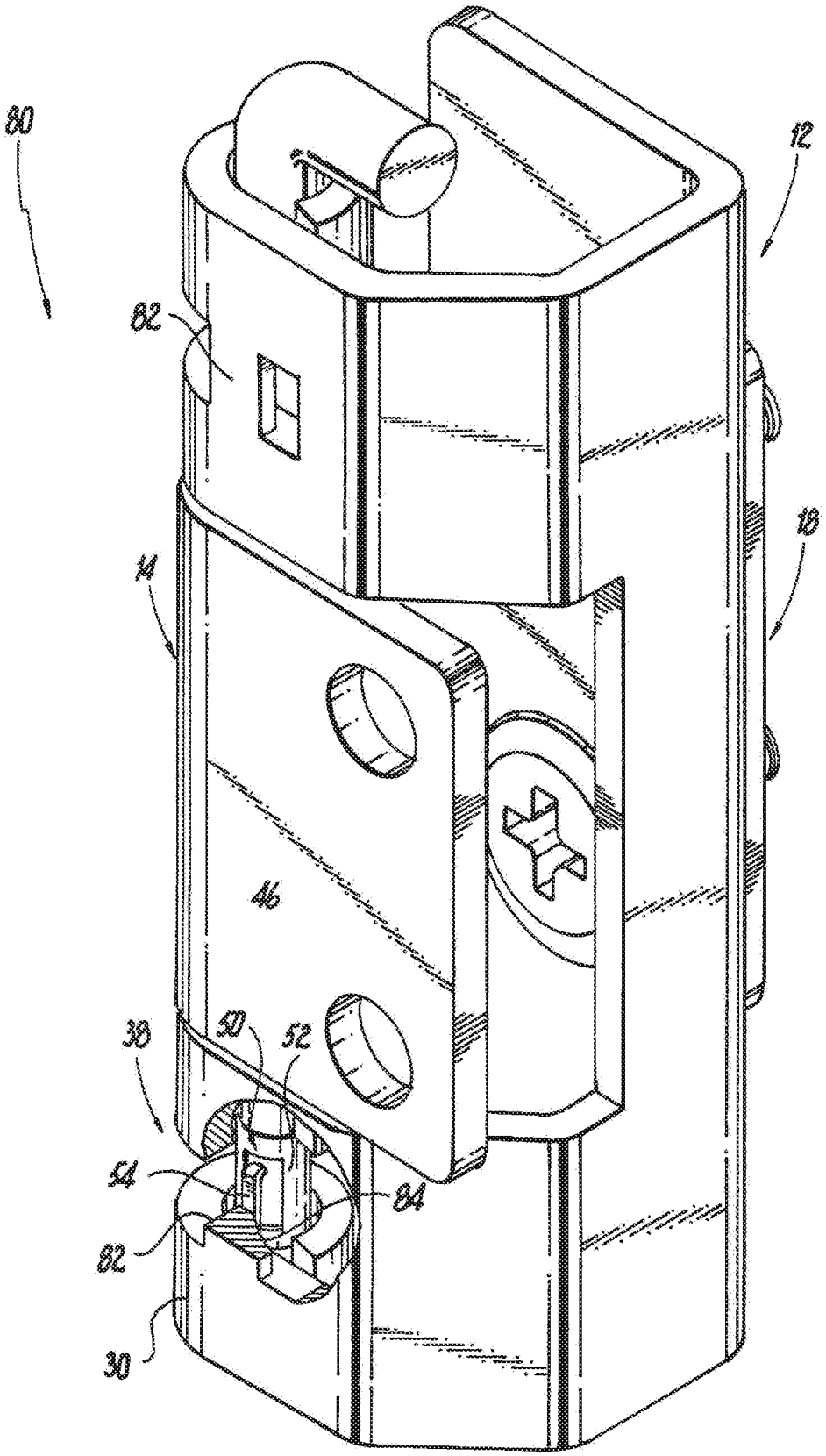
FIG. 7 is a perspective view of another exemplary embodiment of a hinge assembly according to the present disclosure, illustrating a bridge having a camming surface that facilitates moving the hinge pin to the open position.

Referring to FIG. 7, another exemplary embodiment of a hinge assembly 80 according to the present disclosure is shown. In this exemplary embodiment, the hinge assembly 80 is substantially the same as the hinge assembly 10 described above, such that like components will have the same reference numeral as provided above, and for the sake of clarity will not be described again. In this embodiment, the slot 38 in the first pin holder 30 and the slot 42 in the second pin holder 32 have a bridge 82 spanning the respective slot that is configured to maintain the retaining spring 54 in compression when decoupling the tub knuckle 12 from the lid leaf 14 as described above. More specifically, when moving the pin retainer assembly 50 through the slot 38 or 42, the bridge 82 can keep the retaining spring 54 compressed preventing the retainer spring from snapping back to its normal position. The bridge 82 in this exemplary embodiment has an inner surface 84 that provides a camming surface so that the hinge pin 48 can be rotated so that the retaining spring 54 engages the camming surface of the bridge 82 to compress the retaining spring, and thus release the retaining spring from the respective slot 38 or 42. In this embodiment, the retaining spring 54 can be released from the respective slot by rotating the hinge pin assembly 16 instead of pushing the hinge pin assembly 16 further into the pin receiving hole 36. As a result, this embodiment also removes the need to insert a tool, or other instrument or mechanism into the slot 38 to prevent the retaining spring 54 from locking the hinge pin 48 in the closed position as the pin retaining assembly 50 passes through the respective slot.

Figure 8:
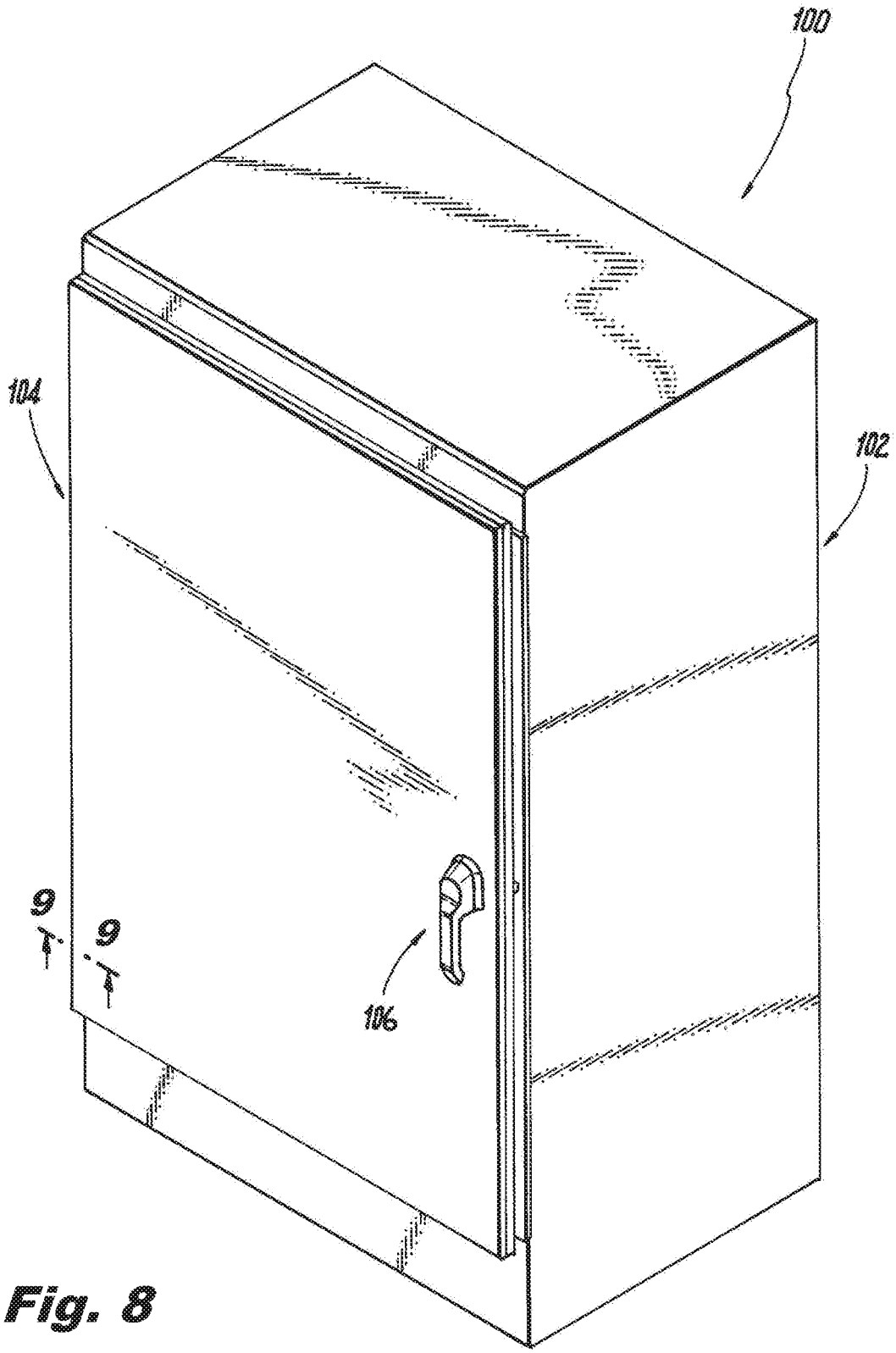
FIG. 8 is a perspective view of an exemplary embodiment of an enclosure with a door in a closed position and utilizing a hinge assembly according to the present disclosure.
Figure 9:
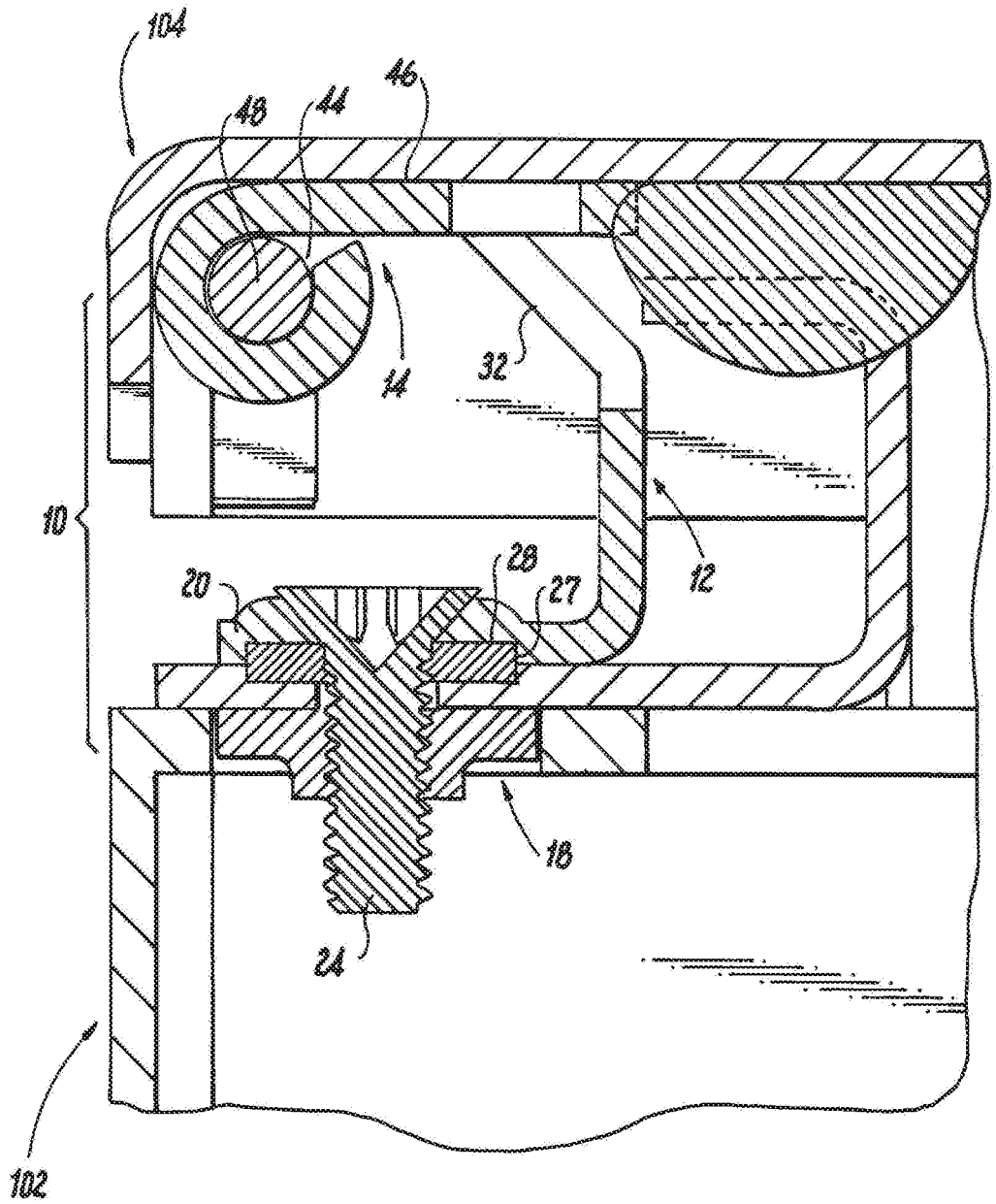
FIG. 9 is a cross-sectional view of the hinge assembly of FIG. 1 installed in the enclosure of FIG. 8 with the enclosure door in the closed position.
Figure 10:
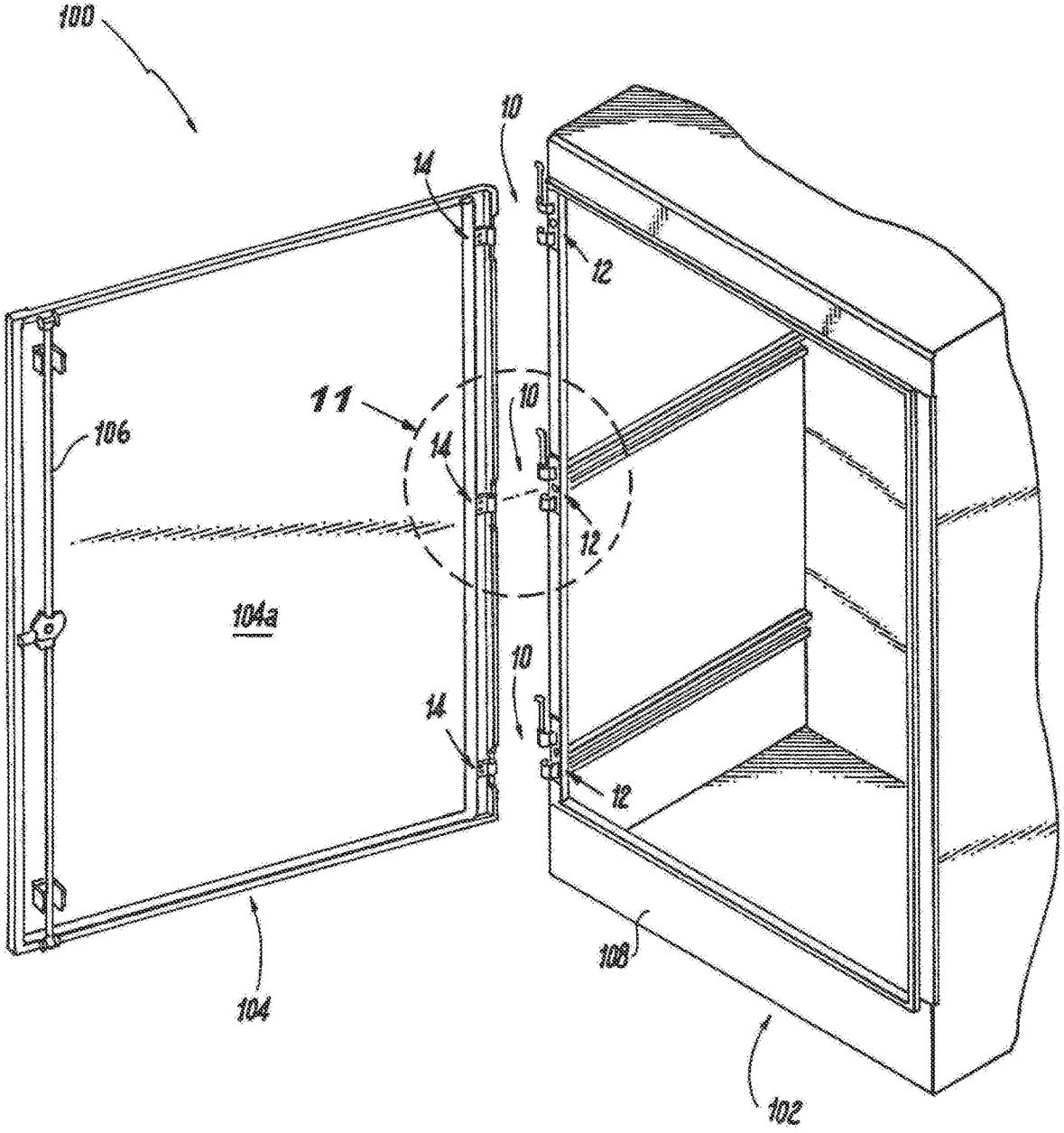
FIG. 10 is a perspective view of the enclosure of FIG. 8 with the door in an open position and removed from a tub of the enclosure.
Figure 11:
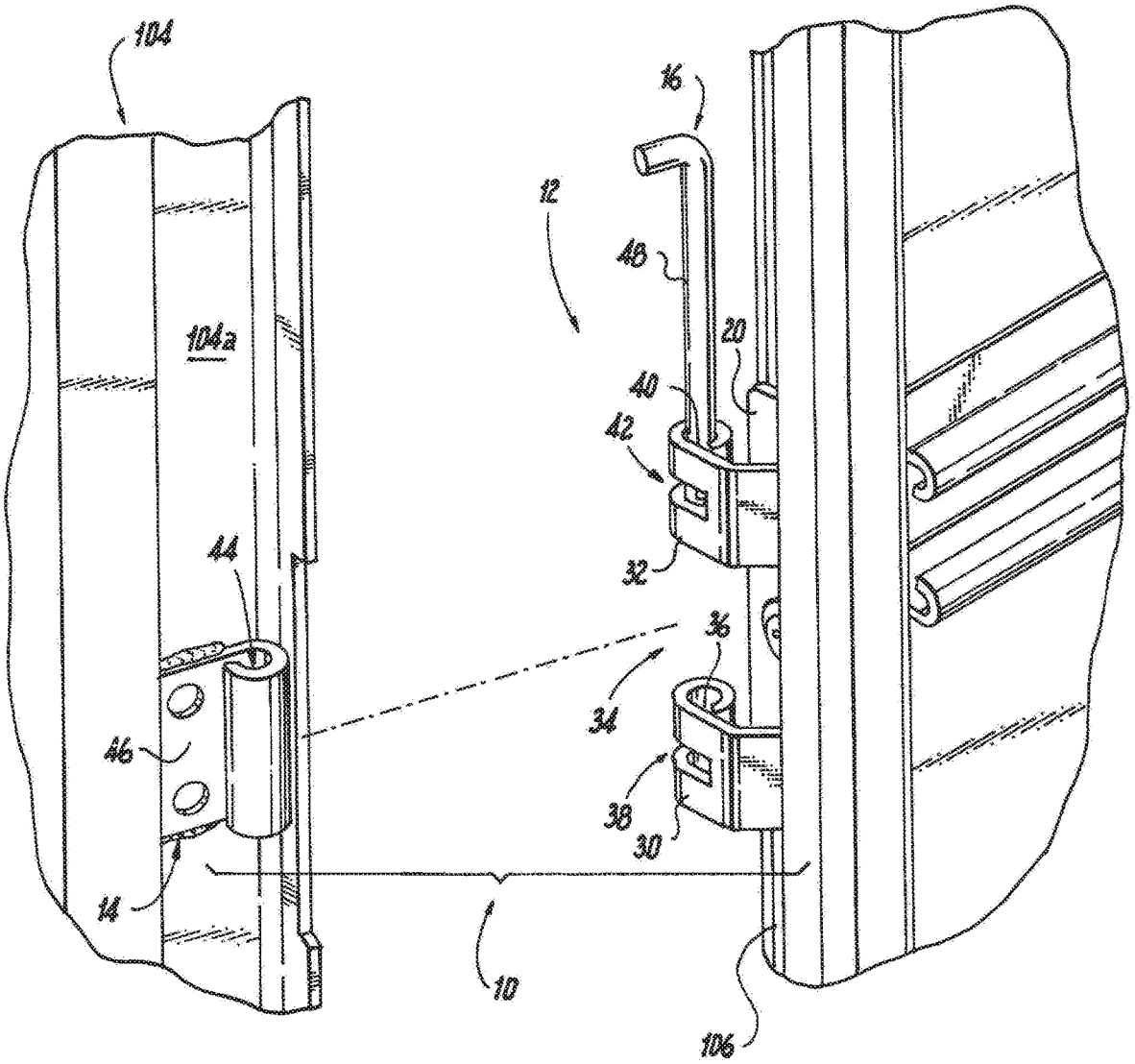
FIG. 11 is an enlarged perspective view of a portion of the enclosure of FIG. 10, illustrating the hinge pin assembly in the open position so that the door can be removed from the enclosure tub.

Turning now to FIGS. 8-11, an exemplary embodiment of an enclosure 100 according to the present disclosure is shown. The enclosure 100 has an enclosure tub 102 and an enclosure door 104. The enclosure door 104 is mounted to the enclosure tub 102 using, for example, the hinge assembly 10 described above. The enclosure door 104 is movable between a closed position, shown in FIG. 8, and an open position, shown in FIG. 10. As seen in FIGS. 8 and 9, using the hinge assembly 10 provides a concealed hinge, where the hinge assembly 10 is not visible when the enclosure door 104 is in the closed position. FIG. 9 shows a cross-sectional view of the hinge assembly 10 mounted to the enclosure 100, and further shows how the hinge assembly is concealed by the enclosure door 104 when in the closed position. The enclosure door 104 may include a known lock assembly 106 to lock the enclosure door 104 in the closed position. Referring to FIGS. 10 and 11, the lid leaf 14 of the hinge assembly 10 is secured to an inner surface **104*a* of the enclosure door 104 by, for example, welding. The tub knuckle 12 of the hinge assembly 10 is secured to the left side of the front wall 108 of the enclosure tub 102 using the retainer bracket 18 and the fasteners 24, as described above. When each hinge pin assembly 16 of each hinge assembly 10 mounted to the enclosure door 104 and to the enclosure tub 102 is moved to the open position, each lid leaf 14 is decoupled from the tub knuckle 12. With each lid leaf 14 decoupled from the tub knuckle 12, the enclosure door 104 can be easily removed from the enclosure tub 102, as seen in FIG. 10**.

In the embodiment of FIGS. 8-11 there is a single enclosure door 104 attached to the front of the enclosure tub 102 using the hinge assembly 10 of the present disclosure. However, the present disclosure contemplates other configurations of the enclosure 100. As a non-limiting example, there may be an enclosure door 104 attached to the front of the enclosure tub 102 using the hinge assembly 10 of the present disclosure, similar to FIG. 8, and enclosure door 104 attached to the rear of the enclosure tub using the hinge assembly 10 of the present disclosure. As another non-limiting example, there may multiple enclosure doors attached to the front of the enclosure tub in, for example, a side-by-side arrangement using the hinge assembly 10 of the present disclosure. As another non-limiting example, there may multiple enclosure doors attached to the front of the enclosure tub in, for example, a side-by-side arrangement using the hinge assembly 10 of the present disclosure, and multiple enclosure doors attached to the rear of the enclosure tub in, for example, a side-by-side arrangement using the hinge assembly 10 of the present disclosure.

While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A hinge assembly comprising:

a tub knuckle having a base, a first pin holder extending from the base and a second pin holder extending from the base and spaced from the first pin holder;

a lid leaf having a mounting plate and a pin holder;

a hinge pin assembly movable between a closed position and an open position, and having a hinge pin and a retainer assembly, wherein the hinge pin can engage the first and second pin holders and the lid leaf pin holder to couple the tub knuckle to the lid leaf, and can disengage from the first pin holder and the lid leaf pin holder to decouple the tub knuckle from the lid leaf, wherein the retainer assembly includes a body secured to the hinge pin and a retainer spring having a first end portion connected to the body and a second free end portion, and wherein the first end extends from the body such that the second free end portion is normally biased away from the hinge pin so that at least a portion of the second free end portion can automatically lock the hinge pin assembly in the closed position and the open position.

2. The hinge assembly according to claim 1, further comprising a retainer bracket used to secure the tub knuckle to a wall in an enclosure tub.

3. The hinge assembly according to claim 1, wherein the first pin holder includes a pin receiving hole and a slot extending at least partially into the pin receiving hole.

4. The hinge assembly according to claim 3, wherein when the at least a portion of the second free end portion is within the slot in the first pin holder the second free end portion can normally bias away from the hinge pin to lock the hinge pin in either the open or closed position.

5. The hinge assembly according to claim 3, wherein the first pin holder has a bridge across the slot, wherein when the at least a portion of the second free end portion is within the slot in the first pin holder the second free end portion can normally bias away from the hinge pin to lock the hinge pin assembly in the closed position, and wherein when the at least a portion of the second free end portion is within the slot in the first pin holder the second free end portion can be compressed by pushing the hinge pin within the pin receiving hole of the first pin holder so that a wall of the first pin holder compresses the at least a portion of the second free end portion and rotating the hinge pin such that the second free end portion is aligned with the bridge so that the hinge pin can be removed from the first pin holder and the lid leaf pin holder.

6. The hinge assembly according to claim 3, wherein the first pin holder has a bridge across the slot the bridge having a camming surface, wherein when the at least a portion of the second free end portion is within the slot in the first pin holder the second free end portion can normally bias away from the hinge pin to lock the hinge pin assembly in the closed position, and wherein when the at least a portion of the second free end portion is within the slot in the first pin holder the second free end portion can be compressed by rotating the hinge pin within the first pin holder so that the camming surface of the bridge compresses the at least a portion of the second free end portion such that the second free end portion is aligned with the bridge so that the hinge pin can be removed from the first pin holder and the lid leaf pin holder.

7. The hinge assembly according to claim 1, wherein the second pin holder includes a pin receiving hole and a slot extending at least partially into the pin receiving hole.

8. The hinge assembly according to claim 7, wherein when the at least a portion of the second free end portion is within the slot in the second pin holder the second free end portion can normally bias away from the hinge pin to lock the hinge pin in either the open or closed position.

9. The hinge assembly according to claim 7, wherein the second pin holder has a bridge across the slot, wherein when the at least a portion of the second free end portion is within the slot in the second pin holder the second free end portion can normally bias away from the hinge pin to lock the hinge pin assembly in the open position, and wherein when the at least a portion of the second free end portion is within the slot in the second pin holder the second free end portion can be compressed by pushing the hinge pin within the pin receiving hole in the second pin holder so that a wall of the second pin holder compresses the at least a portion of the second free end portion and rotating the hinge pin such that the second free end portion is aligned with the bridge so that the hinge pin can be removed from the second pin holder.

10. The hinge assembly according to claim 7, wherein the second pin holder has a bridge across the slot the bridge having a camming surface, wherein when the at least a portion of the second free end portion is within the slot in the second pin holder the second free end portion can normally bias away from the hinge pin to lock the hinge pin assembly in the open position, and wherein when the at least a portion of the second free end portion is within the slot in the second pin holder the second free end portion can be compressed by rotating the hinge pin within the second pin holder so that the camming surface of the bridge compresses the at least a portion of the second free end portion such that the second free end portion is aligned with the bridge so that the hinge pin can be removed from the second pin holder.

11. An enclosure comprising:

an enclosure tub;

an enclosure door releasably mounted to the enclosure tub; and a hinge assembly used to releasably mount the enclosure door to the enclosure tub, the hinge assembly comprising:

a tub knuckle having a base, a first pin holder extending from the base and a second pin holder extending from the base and spaced from the first pin holder;

a lid leaf having a mounting plate and a pin holder;

a hinge pin assembly movable between a closed position and an open position, and having a hinge pin and a retainer assembly, wherein the hinge pin can engage the first and second pin holders and the lid leaf pin holder to couple the tub knuckle to the lid leaf, and can disengage from the first pin holder and the lid leaf pin holder to decouple the tub knuckle from the lid leaf, wherein the retainer assembly includes a body secured to the hinge pin and a retainer spring having a first end portion connected to the body and a second free end portion, and wherein the first end extends from the body such that the second free end portion is normally biased away from the hinge pin so that at least a portion of the second free end portion can automatically lock the hinge pin assembly in the closed position and the open position.

12. The enclosure according to claim 11, further comprising a retainer bracket used to secure the tub knuckle to a wall in the enclosure tub.

13. The enclosure according to claim 11, wherein the lid leaf mounting plate is secured to the enclosure door.

14. The enclosure according to claim 11, wherein the first pin holder includes a pin receiving hole and a slot extending at least partially into the pin receiving hole.

15. The enclosure according to claim 14, wherein when the at least a portion of the second free end portion is within the slot in the first pin holder the second free end portion can normally bias away from the hinge pin to lock the hinge pin in either the open or closed position.

16. The enclosure according to claim 14, wherein the first pin holder has a bridge across the slot, wherein when the at least a portion of the second free end portion is within the slot in the first pin holder the second free end portion can normally bias away from the hinge pin to lock the hinge pin assembly in the closed position, and wherein when the at least a portion of the second free end portion is within the slot in the first pin holder the second free end portion can be compressed by pushing the hinge pin within the pin receiving hole of the first pin holder so that a wall of the first pin holder compresses the at least a portion of the second free end portion and rotating the hinge pin such that the second free end portion is aligned with the bridge so that the hinge pin can be removed from the first pin holder and the lid leaf pin holder.

17. The enclosure according to claim 14, wherein the first pin holder has a bridge across the slot the bridge having a camming surface, wherein when the at least a portion of the second free end portion is within the slot in the first pin holder the second free end portion can normally bias away from the hinge pin to lock the hinge pin assembly in the closed position, and wherein when the at least a portion of the second free end portion is within the slot in the first pin holder the second free end portion can be compressed by rotating the hinge pin within the first pin holder so that the camming surface of the bridge compresses the at least a portion of the second free end portion such that the second free end portion is aligned with the bridge so that the hinge pin can be removed from the first pin holder and the lid leaf pin holder.

18. The enclosure according to claim 11, wherein the second pin holder includes a pin receiving hole and a slot extending at least partially into the pin receiving hole.

19. The enclosure according to claim 18, and wherein when the at least a portion of the second free end portion is within the slot in the second pin holder the second free end portion can normally bias away from the hinge pin to lock the hinge pin assembly in either the open or closed position.

20. The enclosure according to claim 18, wherein the second pin holder has a bridge across the slot, wherein when the at least a portion of the second free end portion is within the slot in the second pin holder the second free end portion can normally bias away from the hinge pin to lock the hinge pin assembly in the open position, and wherein when the at least a portion of the second free end portion is within the slot in the second pin holder the second free end portion can be compressed by pushing the hinge pin within the pin receiving hole in the second pin holder so that a wall of the second pin holder compresses the at least a portion of the second free end portion and rotating the hinge pin such that the second free end portion is aligned with the bridge so that the hinge pin can be removed from the second pin holder.

21. The enclosure according to claim 18, wherein the second pin holder has a bridge across the slot the bridge having a camming surface, wherein when the at least a portion of the second free end portion is within the slot in the second pin holder the second free end portion can normally bias away from the hinge pin to lock the hinge pin assembly in the open position, and wherein when the at least a portion of the second free end portion is within the slot in the second pin holder the second free end portion can be compressed by rotating the hinge pin within the second pin holder so that the camming surface of the bridge compresses the at least a portion of the second free end portion such that the second free end portion is aligned with the bridge so that the hinge pin can be removed from the second pin holder.

22. An enclosure comprising:

an enclosure tub;

an enclosure door; and a hinge assembly comprising:

a tub knuckle secured to the enclosure tub and having a base, a first pin holder extending from the base and a second pin holder extending from the base and spaced from the first pin holder;

a lid leaf secured to the enclosure door and having a mounting plate and a pin holder;

a hinge pin assembly movable between a closed position and an open position, the hinge pin assembly having a hinge pin and a retainer assembly, wherein the hinge pin can engage the first and second pin holders and the lid leaf pin holder to couple the tub knuckle to the lid leaf, and can disengage from the first pin holder and the lid leaf pin holder to decouple the tub knuckle from the lid leaf, wherein the retainer assembly includes a body secured to the hinge pin and a retainer spring having a first end portion connected to the body and a second free end portion, and wherein the first end extends from the body such that the second free end portion is normally biased away from the hinge pin so that at least a portion of the second free end portion can automatically lock the hinge pin assembly in the closed position and the open position.

* * * * *